US011827963B2

(12) United States Patent
Yuya et al.

(10) Patent No.: US 11,827,963 B2
(45) Date of Patent: Nov. 28, 2023

(54) ROUGHLY-SHAPED STEEL MATERIAL FOR NITRIDED PART, AND NITRIDED PART

(71) Applicant: NIPPON STEEL CORPORATION, Tokyo (JP)

(72) Inventors: Masato Yuya, Tokyo (JP); Hiroaki Tahira, Tokyo (JP); Kison Nishihara, Tokyo (JP); Satoru Okawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 302 days.

(21) Appl. No.: 17/289,237

(22) PCT Filed: Oct. 29, 2019

(86) PCT No.: PCT/JP2019/042374
§ 371 (c)(1),
(2) Date: Apr. 28, 2021

(87) PCT Pub. No.: WO2020/090816
PCT Pub. Date: May 7, 2020

(65) Prior Publication Data

US 2022/0010416 A1 Jan. 13, 2022

(30) Foreign Application Priority Data

Oct. 29, 2018 (JP) ..... 2018-202914

(51) Int. Cl.
*C22C 38/40* (2006.01)
*C21D 1/06* (2006.01)
(Continued)

(52) U.S. Cl.
CPC ..... *C22C 38/40* (2013.01); *C21D 1/06* (2013.01); *C21D 6/002* (2013.01); *C21D 6/008* (2013.01);
(Continued)

(58) Field of Classification Search
CPC ..... C21D 1/06; C21D 2211/002; C21D 2211/008; C21D 6/002; C21D 6/008;
(Continued)

(56) References Cited

U.S. PATENT DOCUMENTS 5,906,691 A * 5/1999 Burnett ..... C21D 1/10 148/567
2006/0048860 A1 3/2006 Matsuda et al.
(Continued)

FOREIGN PATENT DOCUMENTS

CN 110184545 A 8/2019
JP S63-317622 A 12/1988
(Continued)

*Primary Examiner* — Jenny R Wu
(74) *Attorney, Agent, or Firm* — SOLARIS Intellectual Property Group, PLLC

(57) ABSTRACT

Provided are a roughly-shaped steel material for a nitrided part, and a nitrided part obtained by nitriding the roughly-shaped steel material for a nitrided part, having a determined chemical composition, in which the portion with a diameter or width ranging from 60 to 130 mm of the roughly-shaped steel material for a nitrided part has a microstructure at a depth of 14.5 mm from a surface including, in terms of area fraction: tempered martensite and tempered bainite in total: from 70 to 100%; remaining austenite: from 0 to 5%; and a balance: ferrite and perlite; and has a microstructure at a depth of 15 mm or more from the surface including, in terms of area fraction: tempered martensite and tempered bainite in total: from 0 to less than 50%; remaining austenite: from 0 to 5%; and a balance: ferrite and perlite.

13 Claims, 7 Drawing Sheets

(51) Int. Cl.

| | |
|---|---|
| ***C21D 6/00*** | (2006.01) |
| ***C21D 9/30*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C23C 8/26*** | (2006.01) |

(52) U.S. Cl.

CPC ..... *C21D 9/30* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C23C 8/26* (2013.01); *C21D 2211/002* (2013.01); *C21D 2211/008* (2013.01)

(58) Field of Classification Search

CPC .. C21D 9/00; C21D 9/30; C22C 38/00; C22C 38/001; C22C 38/002; C22C 38/02; C22C 38/04; C22C 38/06; C22C 38/20; C22C 38/22; C22C 38/24; C22C 38/26; C22C 38/28; C22C 38/40; C22C 38/60; C23C 8/02; C23C 8/26; C23C 8/38; C23C 8/50

See application file for complete search history.

(56) References Cited

U.S. PATENT DOCUMENTS

| | | | |
|---|---|---|---|
| 2015/0038380 | A1 | 2/2015 | Nagamatsu et al. |
| 2019/0010589 | A1 | 1/2019 | Kataoka et al. |

FOREIGN PATENT DOCUMENTS

| | | | | |
|---|---|---|---|---|
| JP | 2004-162161 | A | 6/2004 | |
| JP | 2017-048412 | A | 3/2017 | |
| WO | 2017/056896 | A1 | 4/2017 | |
| WO | WO-2017056896 | A1 * | 4/2017 | ..... C21D 1/06 |
| WO | 2017/119224 | A1 | 7/2017 | |

* cited by examiner

ROUGHLY-SHAPED STEEL MATERIAL FOR NITRIDED PART, AND NITRIDED PART

TECHNICAL FIELD

The present disclosure relates to roughly-shaped steel materials for nitrided parts, and nitrided parts.

BACKGROUND ART

Machine parts used in vehicles, ships, industrial machines, and the like may be nitrided to improve the fatigue strength. In addition to high fatigue strength, nitrided parts may be required to have straightening property to allow deformation during nitriding to be straightened. Fatigue strength tends to be better with higher hardness of the surface, and straightening property tends to be better with lower hardness of the surface, and thus there is a trade-off relationship between the two properties. A technology for achieving both fatigue strength and straightening property is disclosed in, for example, Patent Document 1.

Specifically, Patent Document 1 discloses a technology that attempts to obtain both fatigue strength and straightening property by optimizing the steel composition and controlling the hardness distribution of the nitrided layer and the hardness of the core part outside the range of the nitriding influence after nitriding process.

In general, a pre-heating process such as quenching and tempering or normalizing of steel before nitriding process improves the straightening property and the fatigue strength after nitriding process. In particular, when being quenched and tempered before nitriding and then subjected to a nitriding process, the steel has improved straightening property and fatigue strength, as compared with the case when the nitriding process is performed on a steel immediately after hot forging.

A technology for satisfying both fatigue strength and straightening property after nitriding process by performing quenching and tempering process before nitriding is disclosed in Patent Document 2. Specifically, in Patent Document 2, both fatigue strength and straightening property can be satisfied by controlling the steel microstructure to mainly comprise a mixed microstructure composed of tempered martensite and bainite.

Patent Document 1: Japanese Patent Application Laid-Open (JP-A) No. 2004-162161

Patent Document 2: WO2017-056896

SUMMARY OF INVENTION

Problems to be Solved by the Invention

The technology described in Patent Document 1 has controlled the hardness distribution of the nitrided layer and the hardness of the core part outside the range of the nitriding influence after nitriding process by optimizing the steel composition. However, it is difficult to say that both fatigue strength and straightening property can be satisfied at sufficiently high levels because the steel microstructure has not been optimized.

The technology described in Patent Document 2 has satisfied both fatigue strength and straightening property at high levels. Meanwhile, from the viewpoint of manufacturability of machine parts, it is further desirable that roughly-shaped steel materials before nitriding process have favorable machinability, in addition to the effect described in Patent Document 2.

The nitrided crankshaft described in Patent Document 2 as a nitrided part has been assumed to be a crankshaft having a small crank journal diameter. Thus, the entire part mainly comprises a tempered microstructure and shows no difference between the surface microstructure and the internal microstructure. This means there is room for improvement in machinability of roughly-shaped steel materials before nitriding process.

In particular, a portion with a diameter or width ranging from 60 to 130 mm, which is to be subjected to machining (especially deep-hole drilling), is required to satisfy machinability.

Accordingly, a purpose of the present disclosure is to provide a roughly-shaped steel material for a nitrided part for providing a nitrided part with the portion with a diameter or width ranging from 60 to 130 mm having excellent machinability (in particular, deep-hole machinability), as well as excellent fatigue strength and straightening property after a nitriding process, and a nitrided part obtained by nitriding the roughly-shaped steel material for a nitrided part having excellent fatigue strength and straightening property.

Means for Solving the Problems

Means for solving the problems are as follows:

<1>

A roughly-shaped steel material for a nitrided part having a portion with a diameter or width ranging from 60 to 130 mm, the roughly-shaped steel material for a nitrided part having a chemical composition comprising, by % by mass:

C: from 0.35 to 0.45%;
Si: from 0.10 to 0.50%;
Mn: from 1.5 to 2.5%;
P: 0.05% or less;
S: from 0.005 to 0.100%;
Cr: from 0.15 to 0.60%;
Al: from 0.001 to 0.080%;
N: from 0.003 to 0.025%;
Mo: from 0 to 0.50%;
Cu: from 0 to 0.50%;
Ni: from 0 to 0.50%;
Ti: from 0 to 0.050%;
Nb: from 0 to 0.050%;
Ca: from 0 to 0.005%;
Bi: from 0 to 0.30%;
V: from 0 to 0.05%; and
a balance comprising Fe and impurities;

wherein the portion with a diameter or width ranging from 60 to 130 mm of the roughly-shaped steel material for a nitrided part has a microstructure at a depth of 14.5 mm from a surface comprising, in terms of area fraction:

tempered martensite and tempered bainite in total: from 70 to 100%;
remaining austenite: from 0 to 5%; and
a balance: ferrite and perlite; and wherein the portion with a diameter or width ranging from 60 to 130 mm of the roughly-shaped steel material for a nitrided part has a microstructure at a depth of 15 mm or more from the surface comprising, in terms of area fraction:

tempered martensite and tempered bainite in total: from 0 to less than 50%;
remaining austenite: from 0 to 5%; and
a balance: ferrite and perlite.

<2>

The roughly-shaped steel material for a nitrided part according to <1>, comprising, by % by mass, one or more of:

Mo: from more than 0 to 0.50%;

Cu: from more than 0 to 0.50%; or

Ni: from more than 0 to 0.50%.

<3>

The roughly-shaped steel material for a nitrided part according to <1> or <2>, comprising, by % by mass, one or two of:

Ti: from more than 0 to 0.050%; or

Nb: from more than 0 to 0.050%.

<4>

The roughly-shaped steel material for a nitrided part according to any one of <1> to <3>, comprising, by % by mass, one or more of:

Ca: from more than 0 to 0.005%;

Bi: from more than 0 to 0.30%, or

V: from 0 to 0.50%.

<5>

A nitrided part using as a material the roughly-shaped steel material for a nitrided part according to any one of <1> to <4>, wherein the portion with a diameter or width ranging from 60 to 130 mm of the nitrided part has a microstructure at a depth of 0.5 mm from the surface comprising, in terms of area fraction:

tempered martensite and tempered bainite in total: from 70 to 100%;

remaining austenite: from 0 to 5%; and a balance: ferrite and perlite;

wherein the portion with a diameter or width ranging from 60 to 130 mm of the nitrided part has a microstructure at a depth of 15 mm or more from the surface comprising, in terms of area fraction:

tempered martensite and tempered bainite in total: from 0 to less than 50%;

remaining austenite: from 0 to 5%; and a balance: ferrite and perlite; and wherein the portion with a diameter or width ranging from 60 to 130 mm of the nitrided part has a Vickers hardness at a depth of 0.05 mm from the surface of from 350 to 550 HV.

<6>

The nitrided part according to <5>, comprising, in the portion with a diameter or width ranging from 60 to 130 mm of the nitrided part, a single hole or a plurality of holes having L/D, which is a ratio of a depth L to a diameter D, of 8 or more, with the depth L being 60 mm or more;

wherein 50% or more of a total length of each hole in a depth direction passes through a portion having a microstructure comprising, in terms of area fraction:

tempered martensite and tempered bainite in total: from 0 to less than 50%;

remaining austenite: from 0 to 5%; and a balance: ferrite and perlite.

Effect of the Invention

According to the present disclosure, a roughly-shaped steel material for a nitrided part for providing a nitrided part with the portion with a diameter or width ranging from 60 to 130 mm having excellent machinability (in particular, deep-hole machinability), as well as excellent fatigue strength and straightening property after a nitriding process, and a nitrided part obtained by nitriding the roughly-shaped steel material for a nitrided part having excellent fatigue strength and straightening property can be provided.

DETAILED DESCRIPTION OF THE INVENTION

Figure 1:
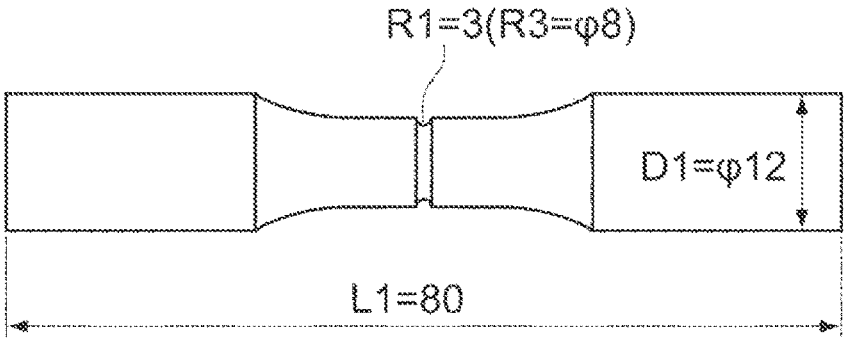
FIG. 1 is a schematic view illustrating an Ono-type rotating bending fatigue test piece obtained from a round bar produced in Example.

Exemplary embodiments of the present disclosure will be described in detail below.

As used herein, the indication "%" for the amount of each element in the chemical composition means "% by mass"

The amount of an element in the chemical composition may be referred to as "element content." For example, the amount of C may be referred to as C content.

A numerical range indicated by the term "to" represents a range including the numerical values described before and after the term "to" as the lower and upper limits.

A numerical range with "more than" or "less than" added to a numerical value described before or after "to," means a range that does not include the numerical value as the lower or upper limit.

The term "process" not only includes an independent process, but also includes a process that is not clearly distinguishable from other processes as long as the desired purpose of the process is achieved.

The position "at a depth of 14.5 mm from the surface of the roughly-shaped steel material for a nitrided part" is also referred to as the surface of the roughly-shaped steel material for a nitrided part.

The position "at a depth of 15 mm or more from the surface of the roughly-shaped steel material for a nitrided part or the nitrided part" is also referred to as internal position.

The position "at a depth of 0.5 mm from the surface of the nitrided part" is also referred to as the surface of the nitrided part.

The roughly-shaped steel material for a nitrided part according to the present embodiment having a portion with a diameter or width ranging from 60 to 130 mm, has a determined chemical composition, wherein the portion with a diameter or width ranging from 60 to 130 mm of the roughly-shaped steel material for a nitrided part has a microstructure at a depth of 14.5 mm from the surface comprising, in terms of area fraction:

tempered martensite and tempered bainite in total: from 70 to 100%;

remaining austenite: from 0 to 5%; and a balance: ferrite and perlite; and wherein the portion with a diameter or width ranging from 60 to 130 mm of the nitrided part has a microstructure at a depth of 15 mm or more from the surface comprising, in terms of area fraction:

tempered martensite and tempered bainite in total: from 0 to less than 50%;

remaining austenite: from 0 to 5%; and a balance: ferrite and perlite.

Such a configuration of the roughly-shaped steel material for a nitrided part according to the present embodiment allows it to provide a nitrided part having excellent machinability (especially, deep-hole machinability), as well as excellent fatigue strength and straightening property after nitriding process in a portion with a diameter (maximum diameter) or width ranging from 60 to 130 mm. In addition, the roughly-shaped steel material for a nitrided part according to the present embodiment can be nitrided to obtain a nitrided part having excellent fatigue strength and straightening property in a portion with a diameter or width ranging from 60 to 130 mm.

Such a roughly-shaped steel material for a nitrided part according to the present embodiment has been found by obtaining the following findings.

To allow a portion with a diameter or width ranging from 60 to 130 mm of the roughly-shaped steel material for a nitrided part to satisfy both fatigue strength and straightening property after nitriding process, as well as higher level of machinability (especially, deep-hole machinability), the microstructure near the surface preferably and maximally contributes to the fatigue strength and straightening property. In addition, the internal microstructure, which does not affect the fatigue strength or the straightening property, but affects the machinability during deep-hole processing, is preferably a different microstructure.

For example, in the technology described in Patent Document 2, the microstructure of the nitrided part mainly comprises tempered martensite and tempered bainite (hereinafter also referred to as "hardended steel structure"), and has no difference between the surficial and the internal microstructures. Use of ferrite and perlite having excellent machinability in the internal microstructure (hereinafter, referred to as "non-hardended steel structure") provides a part that excellent in, in particular, excellent chip control during deep-hole processing.

Accordingly, the present inventors have studied a technology in which a quenching and tempering step performed in a usual manufacturing process of a nitrided part provides a microstructure near the surface of the nitrided part having excellent fatigue strength and straightening property and a microstructure inside the nitrided part having excellent machinability (especially, deep-hole machinability). As a result, the present inventors have obtained the following findings (a) to (c).

(a) A nitrided part excellent in fatigue strength and straightening property, as well as in machinability (especially, deep-hole machinability), can be obtained by allowing the surface of the steel to have a hardended steel structure, and allowing the internal microstructure to be a non-hardended steel structure.

(b) One of requirements for allowing the surface of the steel to have a hardended steel structure, and allowing the internal microstructure to be a non-hardended steel structure is to regulate the diameter and thickness of the portion to be subjected to deep hole processing within a certain range.

(c) The other of the requirements for allowing the surface of the steel to have a hardended steel structure, and allowing the internal microstructure to be a non-hardended steel structure is to regulate the hardenability of the roughly-shaped steel material for a nitrided part within a certain range.

Next, the present inventors have studied conditions that improve the nitriding properties and deep-hole machinability, by using various steels having differential microstructure between the surface and the inside of the steels. As a result, the present inventors have obtained the following findings (d) to (e).

(d) Simply making the microstructure of the surface of a steel mainly comprise a hardended steel structure may result in insufficient improvement of the fatigue strength and straightening property. In order to sufficiently improve the fatigue strength and straightening property, it is necessary to increase the amount of Mn and control the amount of Cr into an appropriate range.

(e) Simply making the microstructure of the inside of a steel mainly comprise a non-hardended steel structure may result in improvement of the chip control, but not in reduction of the machining resistance due to generation of coarse cementite. In order to effectively reduce the machining resistance with the internal microstructure mainly comprising a non-hardended steel structure, the amount of C is required to be kept below a certain amount to reduce the volume fraction of cementite.

Based on the findings described above, the roughly-shaped steel material for a nitrided part according to the present embodiment has been found to be a roughly-shaped steel material for a nitrided part having excellent machinability (especially, deep-hole machinability), as well as excellent fatigue strength and straightening property after nitriding process in a portion with a diameter (maximum diameter) or width ranging from 60 to 130 mm. It also has been found that the roughly-shaped steel material for a nitrided part according to the present embodiment can be nitrided to obtain a nitrided part having excellent fatigue strength and straightening property in a portion with a diameter or width ranging from 60 to 130 mm.

The obtained nitrided part is suitably used as a machine part of, for example, a vehicle, an industrial machine, or a construction machine.

The roughly-shaped steel material for a nitrided part according to the present embodiment will be described in detail below.

[Chemical Composition]

The chemical composition of the roughly-shaped steel material for a nitrided part according to the present embodiment contains the following elements. In the description of the chemical composition, roughly-shaped steel materials for nitrided parts and nitrided parts are also referred to as "steel materials."

(Essential Element)

C: From 0.35 to 0.45%

Carbon (C) increases the hardness and the fatigue strength of the steel material. Too low amount of C will not provide the effect. However, too high amount of C results in a non-hardended steel structure having increased machining resistance and decreased machinability. Therefore, the amount of C is from 0.35 to 0.45%. The lower limit of the amount of C is preferably 0.36%, more preferably 0.38%. The upper limit of the amount of C is preferably 0.43%, more preferably 0.42%, still more preferably 0.41%, particularly preferably 0.40%.

Si: From 0.10 to 0.50%

Silicon (Si) dissolves in ferrite as a solid solution and strengthens the steel material (solid solution strengthening). Too low amount of Si will not provide the effect. However, too high amount of Si results in excessively reduced softening during tempering and deteriorated machinability. Therefore, the amount of Si is from 0.10 to 0.50%. The lower limit of the amount of Si is preferably 0.13%, more preferably 0.15%, still more preferably 0.27% or more. The upper limit of the amount of Si is preferably 0.45%, more preferably 0.40%, still more preferably 0.35%.

Mn: From 1.5 to 2.5%

Manganese (Mn) increases the hardenability of the microstructure and makes the microstructure in the surface a quenched one. This increases the hardness and fatigue strength of the nitrided layer (surface) of the nitrided part. Too low amount of Mn will not provide the effect. However, too high amount of Mn results in excessively increased steel hardenability, quenched internal microstructure, and deteriorated machinability and straightening property. Therefore, the amount of Mn is from 1.5 to 2.5%. The lower limit of the amount of Mn is preferably 1.60%, more preferably 1.70%, still more preferably 1.75%. The upper limit of the amount of Mn is preferably 2.4%, more preferably 2.3%, still more preferably 2.2%.

P: 0.05% or Less

Phosphorus (P) is an impurity. P segregates in the crystalline interface and causes intergranular brittle fracture. Therefore, the amount of P is preferably as low as possible. The upper limit of the amount of P is 0.05% or less. Preferably, the upper limit of the amount of P is 0.02% or less.

Since P is an undesired element, the lower limit of the amount of P is 0%. However, from the point of view of preventing an increase in dephosphorization cost, the lower limit of the amount of P is preferably, for example, more than 0% (preferably 0.003%).

S: From 0.005 to 0.100%

Sulfur (S) combines with Mn to form MnS in the steel material, increasing machinability of the steel material. Too low amount of S will not provide the effect. However, too high amount of S results in formation of coarse MnS, which decreases the fatigue strength of the steel material. Therefore, the amount of S is from 0.005 to 0.100%. The lower limit of the amount of S is preferably 0.010%, more preferably 0.015%, still more preferably 0.020%. The upper limit of the amount of S is preferably 0.080%, more preferably 0.070%, still more preferably 0.060%.

Cr: From 0.15 to 0.60%

Chromium (Cr) combines with N introduced into the steel material by a nitriding process to form CrN in a nitrided layer, strengthening the nitrided layer. Too low amount of Cr will not provide the effect. However, too high amount of Cr results in excessively hardened nitrided layer, leading to deteriorated straightening property. Furthermore, the machinability will be deteriorated. Therefore, the amount of Cr is from 0.15 to 0.60%. The lower limit of the amount of Cr is preferably 0.20%, more preferably 0.25%, still more preferably 0.30%. The upper limit of the amount of Cr is preferably 0.55%, more preferably 0.50%.

Al: From 0.001 to 0.080%

Aluminum (Al) is a steel deoxygenating element. Too high amount of Al results in formation of fine nitrides to excessively harden the steel and deteriorate the straightening property. Therefore, the amount of Al is from 0.001 to 0.080%. The lower limit of the amount of Al is preferably 0.005%, more preferably 0.010%. The upper limit of the amount of Al is preferably 0.060%, more preferably 0.050%, still more preferably 0.040%.

N: From 0.003 to 0.025%

Nitrogen (N) dissolves in a steel material as a solid solution and increases the strength of the steel material. Too low amount of N will not provide the effect. However, too high amount of N results in generation of foams in the steel material. Since foams are defects, it is preferable to prevent the generation of foams. Therefore, the amount of N is from 0.003 to 0.025%. The lower limit of the amount of N is preferably 0.005. The upper limit of the amount of N is preferably 0.020%, more preferably 0.018%.

Balance: Fe and Impurities

Impurities are contaminated from, for example, ores, scraps as roughly-shaped steel materials, or the manufacture environment during industrial manufacture of steel materials, and means those acceptable to the extent that they do not adversely affect the roughly-shaped steel material for a nitrided part according to the present embodiment. Specifically, acceptable impurities include the following elements:

Pb: from 0.09% or less;
W: from 0.1% or less;
Co: from 0.1% or less;
Ta: from 0.1% or less;
Sb: from 0.005% or less;
Mg: from 0.005% or less; and
REM: from 0.005% or less.

(Optional Elements)

The roughly-shaped steel material for a nitrided part according to the present embodiment may contain one or more of Mo, Cu, or Ni. The group consisting of Mo, Cu, and Ni has an effect of increasing the strength of the nitrided part. The lower limits of the amounts of Mo, Cu, and Ni are 0%.

Mo: From 0 to 0.50%

Molybdenum (Mo), when contained, increases the hardenability of steels, thereby increasing the strength of the steel material. As the result, the steel material has increased fatigue strength. However, excessively high amount of Mo results in saturation of the effect and higher cost of the steel material. Therefore, the amount of Mo is from 0 (or more than 0) to 0.50%. The lower limit of the amount of Mo is preferably 0.03%, more preferably 0.05%. The upper limit of the amount of Mo is preferably 0.40%, more preferably 0.30%, still more preferably 0.20%.

Cu: From 0 to 0.50%

Copper (Cu), when contained, dissolves in ferrite as a solid solution and increases the strength of the steel material. As the result, the steel material has increased fatigue strength. However, excessively high amount of Cu results in grain boundary segregation in steel during hot forging and induces hot crack. Therefore, the amount of Cu is from 0 (or more than 0) to 0.50%. The lower limit of the amount of Cu is preferably 0.05%, more preferably 0.10%. The upper limit of the amount of Cu is preferably 0.30%, more preferably 0.20%.

Ni: From 0 to 0.50%

Nickel (Ni), when contained, dissolves in ferrite as a solid solution and increases the strength of the steel material. As the result, the steel material has increased fatigue strength. Ni also reduces hot cracks caused by Cu when the steel material contains Cu. However, too high amount of Ni results in saturation of the effect and higher manufacturing cost of the steel material. Therefore, the amount of Ni is from 0 (or more than 0) to 0.50%. The lower limit of the amount of Ni is preferably 0.05%, more preferably 0.10%. The upper limit of the amount of Ni is preferably 0.30%, more preferably 0.20%.

The roughly-shaped steel material for a nitrided part according to the present embodiment may contain one or two of Ti or Nb. The group consisting of Ti and Nb has an effect of reducing coarsening of austenite grains. The lower limits of the amounts of Mo, Ti, and Nb are 0%.

Ti: From 0 to 0.050%

Titanium (Ti) combines with N to form TiN, thereby reducing grain coarsening during hot forging and during quenching and tempering. However, too high amount of Ti results in generation of TiC and increased variation of the hardness of the steel material. Therefore, the amount of Ti is from 0 (or more than 0) to 0.05%. The lower limit of the amount of Ti is preferably 0.005%, more preferably 0.010%. The upper limit of the amount of Ti is preferably 0.04%, more preferably 0.03%.

Nb: From 0 to 0.050%

Niobium (Nb) combines with N to form NbN, thereby reducing grain coarsening during hot forging and during quenching and tempering. In addition, Nb delays recrystallization and reduces grain coarsening during hot forging and during quenching and tempering. However, too high amount of Nb results in generation of NbC and increased variation of the hardness of the steel material. Therefore, the amount of Nb is from 0 (or more than 0) to 0.050%. The lower limit of the amount of Nb is preferably 0.005%, more preferably 0.010%. The upper limit of the amount of Nb is preferably 0.040%, more preferably 0.030%.

The roughly-shaped steel material for a nitrided part according to the present embodiment may contain one or more of Ca, Bi, or V. The lower limits of the amounts of Ca, Bi, or V are 0%.

Ca: From 0 to 0.005%

Calcium (Ca), when contained, increases the machinability of the steel material. However, too high amount of Ca results in formation of coarse Ca oxide, which decreases the fatigue strength of the steel material. Therefore, the amount of Ca is from 0 (or more than 0) to 0.005%. The lower limit of the amount of Ca to stably achieve the effect is preferably 0.0001%, more preferably 0.0003%. The upper limit of the amount of Ca is preferably 0.003% or less, more preferably 0.002%.

Bi: From 0 to 0.30%

Bismuth (B), when contained, increases the machinability of the steel material. However, too high amount of Bi deteriorates the hot workability. Therefore, the amount of Bi is from 0 (or more than 0) to 0.30%. The lower limit of the amount of Bi to stably achieve the effect is preferably 0.05%, more preferably 0.10%. The upper limit of the amount of Bi is preferably 0.25% or less, more preferably 0.20%.

V: From 0 to 0.05%

Vanadium (V) deposits in the interface between ferrite and austenite during diffusion transformation of steel. Moreover, deposition also progresses during tempering after quenching of steel, resulting in hardening of non-hardended steel structure, and deterioration of the machinability. Therefore, the amount of V should be limited to from 0 (or more than 0) to 0.05% or less. The upper limit of the amount of V is preferably 0.03%, more preferably 0.02%.

The amount of V that is often contained in practical roughly-shaped steel materials for nitrided parts (and nitrided parts) needs to be decreased. From the viewpoint of decreasing the manufacturing cost, the lower limit of the amount of V is preferably more than 0% (or 0.001%).

[Microstructure of Surface Layer of Roughly-Shaped Steel Material for a Nitrided Part]

The roughly-shaped steel material for a nitrided part according to the present embodiment is a component obtained by roughly shaping the steel material into the shape of the nitrided part in hot forging, and then quenching and tempering it. To allow a portion with a diameter or width ranging from 60 to 130 mm in the roughly-shaped steel material for a nitrided part according to the present embodiment to have improved fatigue property and straightening property after nitriding process, the microstructure of the surface to be affected by nitriding in the portion with a diameter or width ranging from 60 to 130 mm is quenched and tempered. When the control is made on the microstructure from the surface to the depth of 15 mm of the roughly-shaped steel material for a nitrided part, the intended microstructure will be shown in the surface even after machining process.

Specifically, the portion with a diameter or width ranging from 60 to 130 mm of the roughly-shaped steel material for a nitrided part has a microstructure at a depth of 14.5 mm from the surface comprising, in terms of area fraction:

tempered martensite and tempered bainite in total: from 70 to 100%;

remaining austenite: from 0 to 5%; and a balance: ferrite and perlite.

This results in improved fatigue property and straightening property of the nitrided part after nitriding.

The lower limit of the total area fraction of tempered martensite and tempered bainite is preferably 80%, more preferably 85%.

The upper limit of the total area fraction of tempered martensite and tempered bainite may be any higher value, even 100%.

The area fraction of remaining austenite may be 0%, or may be 5% or less without affecting the fatigue property and the straightening property of the nitrided part after nitriding process.

The lower limit of the area fraction of remaining austenite may be more than 0% or 1%.

The upper limit of the area fraction of remaining austenite is preferably 3%, more preferably 2%.

The total area fraction of "ferrite and perlite" in the balance may be 0%, or may preferably be 30% or less, which unlikely affects the fatigue property and the straightening property of the nitrided part after nitriding process.

[Internal Microstructure of Roughly-Shaped Steel Material for a Nitrided Part]

In the roughly-shaped steel material for a nitrided part according to the present embodiment, the major part of the internal microstructure outside the range of the nitriding influence is required to be non-hardended steel structure, in order to improve the machinability of the nitrided part after nitriding process in a portion with a diameter or width ranging from 60 to 130 mm the machinability of the nitriding part after the nitriding treatment in the portion having a diameter or width in the range of 60 to 130 mm, Specifically, the portion with a diameter or width ranging from 60 to 130 mm of the roughly-shaped steel material for a nitrided part has a microstructure at a depth of 15 mm or more comprising, in terms of area fraction:

tempered martensite and tempered bainite in total: from 0 to less than 50%;

remaining austenite: from 0 to 5%; and a balance: ferrite and perlite. This results in improved machinability (especially, deep-hole machinability) of the nitrided part after nitriding process.

The lower limit of the total area fraction of tempered martensite and tempered bainite may be 0%, or may be less than 50%, which unlikely affects the machinability (especially deep-hole machinability) of the nitrided part after nitriding process.

The lower limit of the total area fraction of tempered martensite and tempered bainite may be more than 0%, 5%, or 10%.

The upper limit of the total area fraction of tempered martensite and tempered bainite is preferably 40%, more preferably 35%, still more preferably 30%, particularly preferably 20%.

The area fraction of remaining austenite may be 0%, or may be 5% or less without affecting the machinability (especially, deep-hole machinability) of the nitrided part after nitriding process.

The lower limit of the area fraction of remaining austenite may be more than 0% or 1%.

The upper limit of the area fraction of remaining austenite is preferably 3%, more preferably 2%.

The total area fraction of "ferrite and perlite" as the balance is from more than 50 to 100%.

The lower limit of the total area fraction of "ferrite and perlite" as the balance is preferably 60%, more preferably 65%, still more preferably 70%, particularly preferably 80%.

The upper limit of the total area fraction of "ferrite and perlite" as the balance may be any higher value, even 100%.

The nitriding process is performed in the temperature range below the Al point of steel, and the internal microstructure of the roughly-shaped steel material for a nitrided part is directly succeeded by the internal microstructure of the nitrided part.

<Nitrided Part>

The nitrided part according to the present embodiment is a nitrided part using as a material the above-described roughly-shaped steel material for a nitrided part according to the embodiment. Specifically, it is a nitrided part obtained by subjecting the roughly-shaped steel material for a nitrided part to a machining process to achieve a predetermined shape, followed by nitriding process.

In addition, the nitrided part according to the present embodiment meets the following properties (1) to (3):

(1) the portion with a diameter or width ranging from 60 to 130 mm of the nitrided part has a microstructure at a depth of 0.5 mm from the surface comprising, in terms of area fraction:

tempered martensite and tempered bainite in total: from 70 to 100%;

remaining austenite: from 0 to 5%; and a balance: ferrite and perlite;

(2) the portion with a diameter or width ranging from 60 to 130 mm of the nitrided part has a microstructure at a depth of 15 mm or more from the surface comprising, in terms of area fraction:

tempered martensite and tempered bainite in total: from 0 to less than 50%;

remaining austenite: from 0 to 5%; and a balance: ferrite and perlite; and (3) the portion with a diameter or width ranging from 60 to 130 mm of the nitrided part has a Vickers hardness at a depth of 0.05 mm from the surface of from 350 HV to less than 550 HV.

As described above, the nitrided part according to the present embodiment is a nitrided part that is excellent in machinability (especially, deep-hole machinability), as well as in fatigue strength and straightening property.

[Microstructure of Surface Layer of Nitrided Part]

The nitrided part according to the present embodiment is obtained by subjecting the roughly-shaped steel material for a nitrided part to a nitriding process, and thus has a nitrided layer formed on the surface. The thickness of the nitrided layer is, for example, from 0.1 to 1.0 mm.

To allow a portion with a diameter or width ranging from 60 to 130 mm of the nitrided part according to the present embodiment to have improved fatigue property and straightening property, the microstructure of the nitrided layer in the portion with a diameter or width ranging from 60 to 130 mm is preferably quenched.

Specifically, the portion with a diameter or width ranging from 60 to 130 mm of the nitrided part has a microstructure at a depth of 0.5 mm from the surface comprising, in terms of area fraction:

tempered martensite and tempered bainite in total: from 70 to 100%;

remaining austenite: from 0 to 5%; and a balance: ferrite and perlite.

The lower limit of the total area fraction of tempered martensite and tempered bainite is preferably 80%, more preferably 85%.

The upper limit of the total area fraction of tempered martensite and tempered bainite may be any higher value, even 100%.

The area fraction of remaining austenite may be 0%, or may be 5% or less without affecting the fatigue property and the straightening property of the nitrided part.

The lower limit of the area fraction of remaining austenite may be more than 0% or 1%.

The upper limit of the area fraction of remaining austenite is preferably 3%, more preferably 2%.

The total area fraction of "ferrite and perlite" in the balance may be 0%, or may preferably be 30% or less, which unlikely affects the fatigue property and the straightening property of the nitrided part.

When the area fraction of the microstructure at a depth of 0.5 mm from the surface in a portion with a diameter or width ranging from 60 to 130 mm of the nitrided part meets the above specification, the microstructure in a portion closer to the surface, which is more easily quenched, will naturally meet the above specification.

[Internal Microstructure of Nitrided Part]

To improve the machinability of the nitrided part according to the present embodiment in a portion with a diameter or width ranging from 60 to 130 mm, the major part of the internal microstructure outside the range of the nitriding influence is required to be non-hardended steel structure.

Specifically, the portion with a diameter or width ranging from 60 to 130 mm of the nitrided part has a microstructure at a depth of 15 mm or more comprising, in terms of area fraction:

tempered martensite and tempered bainite in total: from 0 to less than 50%;

remaining austenite: from 0 to 5%; and a balance: ferrite and perlite.

This results in improved machinability (especially, deep-hole machinability) of the nitrided part in the portion with a diameter or width ranging from 60 to 130 mm.

The lower limit of the total area fraction of tempered martensite and tempered bainite may be 0%, or may be less than 50%, which unlikely affects the machinability (especially deep-hole machinability) of the nitrided part.

The lower limit of the total area fraction of tempered martensite and tempered bainite may be more than 0%, 5%, or 10%.

The upper limit of the total area fraction of tempered martensite and tempered bainite is preferably 40%, more preferably 35%, still more preferably 30%, particularly preferably 20%.

The area fraction of remaining austenite may be 0%, or may be 5% or less without affecting the machinability (especially, deep-hole machinability) of the nitrided part.

The lower limit of the area fraction of remaining austenite may be more than 0% or 1%.

The upper limit of the area fraction of remaining austenite is preferably 3%, more preferably 2%.

The total area fraction of "ferrite and perlite" as the balance is from more than 50 to 100%.

The lower limit of the total area fraction of "ferrite and perlite" as the balance is preferably 60%, more preferably 65%, still more preferably 70%, particularly preferably 80%.

The upper limit of the total area fraction of "ferrite and perlite" as the balance may be any higher value, even 100%.

[Vickers Hardness of Surface Layer of Nitrided Part]

To allow a portion with a diameter or width ranging from 60 to 130 mm of the nitrided part according to the present embodiment to have improved fatigue property and straightening property, the surface of the nitrided part is required to have an appropriate Vickers hardness. Low hardness near the surface results in insufficiently high fatigue strength. Too high hardness near the surface results in deteriorated straightening property. Therefore, the Vickers hardness of the surface of the nitrided part is from 350 to 550 HV.

Specifically, the portion with a diameter or width ranging from 60 to 130 mm of the nitrided part has a Vickers hardness at a depth of 0.05 mm from the surface of from 350 to 550 HV.

The lower limit of the Vickers hardness of the surface of the nitrided part is preferably 370 HV, more preferably 380 HV.

The upper limit of the Vickers hardness of the surface of the nitrided part is preferably 520 HV, more preferably 500 HV.

[Through-Hole of Nitrided Part]

The nitrided part according to the present embodiment may have a single hole or a plurality of holes in a portion with a diameter or width ranging from 60 to 130 mm of the nitrided part. The hole is provided, for example, by drill machining.

The hole is, for example, a through-hole having L/D, which is a ratio of the depth L to the diameter D, of 8 or more (preferably from 8 to 50), with the depth L being 60 mm or more (preferably from 60 to 250 mm).

The drill machining process for holes of this shape is a difficult-to-machine process, and it is advantageous that the portion to be subjected to drill machining has a microstructure containing relatively low amounts of tempered martensite and tempered bainite having poor machinability and high amounts of ferrite and perlite having excellent machinability.

Thus, 50% or more (preferably 60%, more preferably 70%) of the total length in the depth direction of the each hole having this shape preferably passes through a portion having a microstructure comprising, in terms of area fraction:

tempered martensite and tempered bainite in total: from 0 to less than 50%;

remaining austenite: from 0 to 5%; and a balance: ferrite and perlite.

In other words, for example, 50% or more of the total length in the depth direction of the hole, of the microstructure of the portion penetrated by a drill, preferably is a microstructure mainly containing ferrite and perlite as described above.

The preferred embodiment of the microstructure mainly containing ferrite and perlite is the same as the preferred embodiment of the microstructure at a depth of 15 mm or more from the surface of the nitrided part.

The hole microstructure is evaluated from the microstructure around the hole. Specifically, the evaluation is made by the following method.

First, the depth of the hole is divided into ten equal parts in the depth direction, which define ten regions. In each region, the hole is cut longitudinally along the depth direction. In the longitudinal section, the visual field randomly positioned within 200 depth from the surface (wall surface) of the hole is considered as a visual field to be tested.

From one or more visual fields to be tested, visual fields are selected so that the area to be tested is 0.2 $mm^2$ or more for each of the region, and photographed at an appropriate magnification to observe the microstructure. From the obtained photographs, the area fractions of the microstructure are determined in each of the regions. The length of the hole that meets the specification for the area fraction of the microstructure (the length in the depth direction of the hole) is the number of regions that meet the above-described specification for the area fraction of the microstructure of regions on the surface (wall surface) of the hole, multiplied by 1/10 of the length of the hole. Such an evaluation is performed for all holes, and the ratio of the sum of the lengths that meet the specification for the area fraction of the microstructure to the total length of the hole in the depth direction is determined.

For multiple holes whose microstructure therearound can be reasonably presumed to be the same, for example, in the case where the nitrided part has multiple through-holes, and the holes and a portion having the holes have symmetrical shapes, or a portion composed of repetition of the same shape has holes of the same shape, only one hole of them is evaluated for the microstructure around the hole, and the area fraction of the microstructure around the other hole may be considered to be the same as the result of the evaluation.

[Area Fraction and Vickers Hardness of Microstructure]

The area fraction and Vickers hardness of a microstructure in the roughly-shaped steel material for a nitrided part and the nitrided part according to the present embodiment are measured according to the methods described in the following Examples.

[Manufacturing Method]

An illustrative method of manufacturing the roughly-shaped steel material for a nitrided part and the nitrided part according to the present embodiment will be described below.

The method of manufacturing the nitrided part according to the present embodiment comprises the steps of preparing steel materials, molding, quenching and tempering, machining, and nitriding. For the roughly-shaped steel material for a nitrided part according to the present embodiment, the method comprises the steps of preparing steel materials, molding, and quenching and tempering.

Now, the steps will be described individually.

[Step of Preparing Steel Materials]

Molten steel that satisfies the chemical composition of steel of the roughly-shaped steel material for a nitrided part according to the present embodiment is produced. The produced molten steel is used to obtain a slab or bloom by a general continuous casting method. Alternatively, the molten steel is used to obtain an ingot by an ingot casting method. The slab or bloom, or the ingot is subjected to hot working to produce a billet. The hot working may be hot rolling or hot forging. Further, the billet heated, rolled, and cooled under general conditions to obtain a bar steel, which is used as a material of the nitrided part.

[Molding Step]

The produced bar steel described above is molded into a roughly-shaped steel material for a nitrided part having a portion with a diameter or width ranging from 60 to 130 mm by hot forging. Too low heating temperature in hot forging results in excessive load on the forging machine. On the other hand, too high heating temperature results in high scale loss. Thus, the heating temperature is preferably from 1000 to 1300° C.

The finishing temperature in hot forging is preferably 900° C. or higher. It is because too low finishing temperature results in increased burden on the mold. The upper limit of the finishing temperature is preferably 1250° C.

[Quenching and Tempering]

The roughly-shaped steel material for a nitrided part after hot forging was subjected to quenching and tempering. During this, the quenching temperature is A3 point or higher represented by Formula (1) and 1000° C. or lower. The tempering temperature is 570° C. or higher and Al point or lower represented by Formula (2). The tempering time is preferably 30 minutes or longer.

$$A3=910-203C+44.7Si-30Mn-11Cr \quad (1)$$

$$A1=723-10.7Mn+29.1Si-16.9Ni+16.9Cr \quad (2)$$

In Formulae (1) and (2), the symbols of element represent the content (% by mass) of the elements.

To make the microstructure immediately before quenching a single-phase austenite, the quenching temperature is required to be A3 point or higher. Too high quenching temperature may result in increased hardenability, quenching reaching the inside, and deteriorated machinability. Thus, the quenching temperature is preferably 950° C. or lower. The quenching temperature is more preferably 920° C. or lower, still more preferably 900° C. or lower.

Quenching allows the microstructure of the surface of the roughly-shaped steel material to mainly comprise martensite and bainite. Direct nitriding of such a microstructure results in accelerated deposition of alloy nitride, excessive hardening of the surface, and deteriorated straightening property. To reduce the deposition of alloy nitride in martensite and bainite by tempering, the tempering temperature is preferably 570° C. or higher. The tempering temperature is more preferably 590° C. or higher, still more preferably 600° C. or higher. To reduce reverse transformation during tempering, the tempering temperature is required to be Al point or lower.

The roughly-shaped steel material for a nitrided part according to the present embodiment is obtained through the above-described steps.

[Machining Step]

The obtained roughly-shaped steel material for a nitrided part is machined to form a predetermined shape of a nitrided part.

[Nitriding]

The nitrided part after machining is subjected to a nitriding process. The present embodiment employs a well-known nitriding process. The nitriding process is, for example, gas nitriding, salt bath nitriding, or ion nitriding. The gas introduced in the furnace during nitriding may be only $NH_3$, or a mixture containing $NH_3$ and $N_2$ and/or $H_2$. The gas may also contain carburizing gas for a soft nitriding process. Thus, as used herein, the term "nitriding" includes "soft nitriding."

For a gas soft nitriding process, for example, soaking in an atmosphere containing a 1:1 mixture of endothermic converted gas (RX gas) and ammonia gas at a soaking temperature from 550 to 630° C. for 1 to 3 hours is preferably performed.

The nitrided part manufactured by the manufacturing steps described above is excellent in machinability (especially, in deep-hole machinability), as well as in fatigue strength and straightening property.

[Use of Nitrided Part]

The nitrided part can be suitably applied to, for example, crankshafts, various mechanical sliding parts (such as camshafts and bearings), and molds for forming steel products (such as press forming dies and plugs for tube manufacturing).

In the case where the nitrided part is a crankshaft, specifically, the crankshaft preferably has a crank journal diameter (maximum diameter) of from 60 to 130 mm (preferably from 60 to 120 mm, more preferably from 65 to 100 mm) (see FIG. 7), from the viewpoint of obtaining the above-described surface and internal microstructures.

Too small crank journal diameter of the crankshaft results in both the surface and internal microstructures mainly comprising tempered microstructure (mainly comprising tempered martensite and tempered bainite), which leads to a tendency to provide a microstructure without difference between the surface and the inside. On the other hand, too large crank journal diameter of the crankshaft results in both the surface and the inside mainly comprising ferrite and perlite, which leads to a tendency to provide a microstructure without difference between the surface and the inside.

Thus, the nitrided part is preferably a crankshaft having a crank journal diameter (maximum diameter) of from 60 to 130 mm (preferably from 60 to 120 mm, more preferably from 65 to 100 mm) as described above.

Similarly, the roughly-shaped steel material for a nitrided part is preferably a roughly-shaped steel material for crankshaft having a diameter of a portion corresponding to crank journal (maximum diameter) of from 60 to 130 mm (preferably from 60 to 120 mm, more preferably from 65 to 100 mm).

Figure 7:
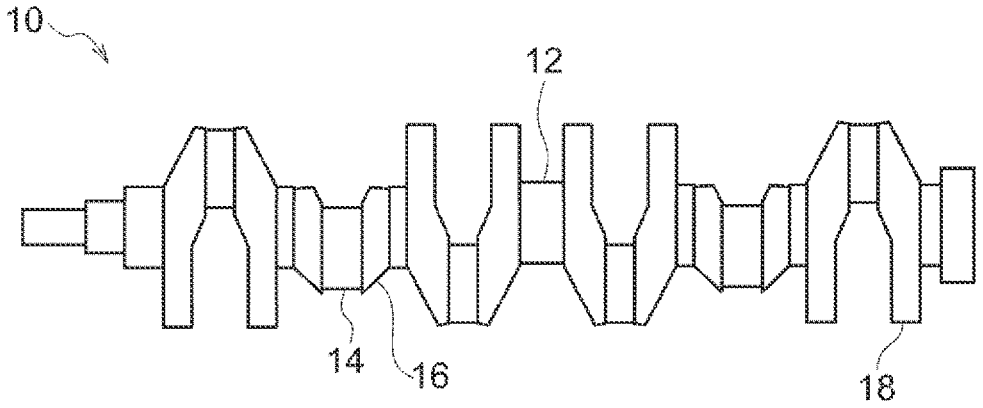
FIG. 7 is a schematic view illustrating an example of a crankshaft.

In FIG. 7, 10 represents crankshaft, the portion 12 represents crank journal, the portion 14 represents crankpin, the portion 16 represents crankarm, and the portion 18 represents balance weight.

An example corresponding to the "portion with a diameter or width ranging from 60 to 130 mm" in a crankshaft is crank journal.

Examples

The present disclosure will now be described in more detail with reference to Examples. However, these Examples do not limit the present disclosure.

First, 300 kg ingots of steels C, E, and H having the chemical composition shown in Table 1, and 50 kg ingots of A, B, D, F, and I to U were produced using a vacuum melting furnace.

TABLE 1

| | Chemical composition (% by mass) | | | | | | | | | | | | | | | | | |
|---|---|---|---|---|---|---|---|---|---|---|---|---|---|---|---|---|---|---|
| | C | Si | Mn | P | S | Cu | Ni | Cr | Mo | Al | Ti | Nb | V | Ca | Bi | N | A1 | A3 |
| A | 0.35 | 0.25 | 2.22 | 0.01 | 0.044 | — | — | 0.50 | — | 0.020 | — | — | — | — | 0.15 | 0.0074 | 698 | 778 |
| B | 0.36 | 0.18 | 2.25 | 0.012 | 0.038 | — | — | 0.39 | — | 0.019 | — | — | — | — | — | 0.0088 | 698 | 773 |
| C | 0.36 | 0.11 | 2.28 | 0.011 | 0.076 | — | — | 0.25 | — | 0.021 | — | — | — | — | — | 0.0142 | 698 | 771 |
| D | 0.39 | 0.18 | 1.99 | 0.01 | 0.055 | — | — | 0.43 | — | 0.022 | — | — | — | — | — | 0.0055 | 700 | 774 |
| E | 0.40 | 0.20 | 2.01 | 0.011 | 0.044 | — | — | 0.44 | — | 0.016 | 0.017 | — | — | — | — | 0.0090 | 700 | 773 |
| F | 0.41 | 0.15 | 1.90 | 0.009 | 0.042 | — | — | 0.45 | — | 0.018 | — | 0.018 | — | — | — | 0.0089 | 699 | 772 |
| G | 0.43 | 0.25 | 1.81 | 0.008 | 0.052 | — | — | 0.55 | — | 0.018 | — | — | 0.01 | — | — | 0.0084 | 702 | 774 |
| H | 0.44 | 0.19 | 1.95 | 0.01 | 0.055 | — | — | 0.42 | — | 0.015 | — | — | — | — | — | 0.0052 | 701 | 766 |
| I | 0.44 | 0.10 | 2.20 | 0.011 | 0.078 | — | — | 0.25 | — | 0.020 | — | — | — | — | — | 0.0122 | 698 | 756 |
| J | 0.42 | 0.15 | 1.91 | 0.01 | 0.038 | — | — | 0.40 | — | 0.015 | — | — | — | 0.0015 | — | 0.0135 | 700 | 770 |
| K | 0.42 | 0.14 | 1.76 | 0.01 | 0.039 | 0.24 | — | 0.39 | — | 0.015 | — | — | — | — | — | 0.0122 | 702 | 774 |
| L | 0.42 | 0.15 | 1.75 | 0.01 | 0.042 | — | 0.20 | 0.40 | — | 0.015 | — | — | — | — | — | 0.0122 | 705 | 775 |
| M | 0.42 | 0.16 | 1.90 | 0.01 | 0.044 | — | — | 0.40 | 0.05 | 0.017 | — | — | — | — | — | 0.0122 | 701 | 770 |
| N | 0.42 | 0.15 | 1.75 | 0.01 | 0.040 | — | — | 0.39 | — | 0.002 | — | — | — | — | — | 0.0118 | 702 | 775 |
| O | 0.55 | 0.19 | 1.88 | 0.015 | 0.040 | — | — | 0.25 | — | 0.016 | — | — | — | — | — | 0.0155 | 704 | 748 |
| P | 0.44 | 0.16 | 1.82 | 0.011 | 0.049 | — | — | 0.35 | — | 0.018 | — | — | 0.10 | — | — | 0.0066 | 702 | 769 |
| Q | 0.31 | 0.14 | 1.85 | 0.011 | 0.055 | — | — | 0.25 | — | 0.020 | — | — | — | — | — | 0.0091 | 703 | 795 |
| R | 0.40 | 0.20 | 1.22 | 0.011 | 0.040 | — | — | 0.29 | — | 0.016 | — | — | — | — | — | 0.0063 | 711 | 798 |
| S | 0.44 | 0.11 | 2.74 | 0.009 | 0.043 | — | — | 0.42 | — | 0.019 | — | — | — | — | — | 0.0089 | 690 | 739 |
| T | 0.44 | 0.11 | 2.22 | 0.011 | 0.075 | — | — | 0.66 | — | 0.002 | — | — | — | — | — | 0.0084 | 691 | 752 |
| U | 0.40 | 0.19 | 0.80 | 0.011 | 0.052 | — | — | 0.16 | — | 0.023 | — | — | — | — | — | 0.0066 | 717 | 812 |

The columns "A1" and "A3" in Table 1 describe A1 point (° C.) defined by Formula (1), and A3 point (° C.) defined by Formula (2), respectively.

The ingots having the marks were heated at 1250° C. The heated ingot was hot forged to produce a bar steel having a diameter φ shown in Table 2. The bar steel as a material was subjected to thermal treatment simulating the production of the roughly-shaped steel material for a nitrided part. The bar steel was first heated at 1200° C. and then air cooled, which simulates the hot forging step. Then, the air-cooled round bar was heated (quenched) under conditions described in the first step of the thermal treatment column in Table 2 and cooled to 150° C. or lower, and then was heated (tempered) under conditions described in the second step of the thermal treatment column in Table 2.

Through the above steps, round bars as roughly-shaped steel materials for a nitrided part were produced.

<Evaluation Test>

The round bars of the test numbers were tested as follows.

[Measurement of Area Fraction and Vickers Hardness of Microstructure]

Samples of the round bars after the two-step thermal treatment of Test Nos. 1 to 30 having a transverse section (cross section cut perpendicular to the longitudinal direction of the round bar) as a surface to be tested were obtained. The Vickers hardness (HV) based on JIS Z 2244 (2009) was measured at any seven points of the obtained samples at a depth of 14.5 mm from the surface (outer surface) of the round bar (surface). The test force was 9.8 N. The average of the seven Vickers hardness values obtained was defined as the Vickers hardness of the surface.

The sample after measuring the Vickers hardness of the surface was corroded with nital containing 3% by mass nitric acid to reveal the microstructure. Then, seven optical micrographs were taken at a magnification of 200× with the position where the hardness was measured (surface) as the center. The area fractions of tempered martensite, tempered bainite, and ferrite and perlite were determined by image analysis.

For the same sample, the volume fraction of remaining austenite was measured using an XRD (X-ray diffractometer). X-rays were irradiated in a spot size of φ1.0 mm, with the position at a depth of 14.5 mm from the surface (outer surface) of the round bar as the center. The obtained volume fraction of remaining austenite was defined as the area fraction of remaining austenite in the surface.

Remaining austenite is included in tempered martensite and tempered bainite. Therefore, the true total area fraction of tempered martensite and tempered bainite was obtained by subtracting the area fraction of remaining austenite measured by XRD from the total area fraction of tempered martensite and tempered bainite determined from the optical micrographs.

Using the same method, the Vickers hardness and the area fraction of a microstructure at a depth of 15 mm or more from the surface (outer surface) of (inside) the round bar were also measured. Specifically, the measurements were as follows.

The Vickers hardness (HV) was measured at three points at or near each of the five positions, a depth of 15 (mm), a depth of 15+(R−15)/4×1 (mm), a depth of 15+(R−15)/4×2 (mm), a depth of 15+(R−15)/4×3 (mm), and a depth of R (mm), from the surface (outer surface) of the round bar, where the radius of the round bar is R (mm). The test force was 9.8 N. The average of the 15 Vickers hardness values obtained was defined as the hardness of the inside.

The sample after measuring the Vickers hardness of the inside was corroded with nital containing 3% by mass nitric acid to reveal the microstructure. Then, an optical micrograph was taken at a magnification of 200× with the position where the hardness was measured as the center. The area fractions of tempered martensite, tempered bainite, and ferrite and perlite were determined by image analysis.

For the sample with the Vickers hardness measured, the volume fraction of remaining austenite was further measured using an XRD. X-rays were irradiated in a spot size of φ1.0 mm, with the position where the hardness had been measured as the center. The obtained volume fraction of remaining austenite was defined as the area fraction of remaining austenite inside.

The total area fraction of tempered martensite and tempered bainite was obtained by subtracting the area fraction of remaining austenite measured by XRD from the total area fraction of tempered martensite and tempered bainite determined from the optical micrographs.

The average of the obtained 15 total area fraction of tempered martensite and tempered bainite, and area fraction of remaining austenite was defined as the hardness of the inside.

[Preparation of Test Pieces for Ono-Type Rotating Bending Fatigue Test and Four-Point Bending Test]

A plurality of Ono-type rotating bending fatigue test pieces shown in FIG. 1 were taken from the round bars of each test number. The length L1 in the figure was 80 mm and the diameter D1 was φ12 mm. The radius of curvature R1 of the notch in the center of the test piece was 3 mm, and the diameter R3 of the transverse section of the test piece at the notch bottom was φ8 mm. The center of the Ono-type rotating bending fatigue test piece was made to be 10 mm deep from the surface of the round bar. This means that the notch bottom of the Ono-type rotating bending fatigue test piece corresponds to a depth of from 6 to 14 mm from the surface of the round bar.

Figure 2:
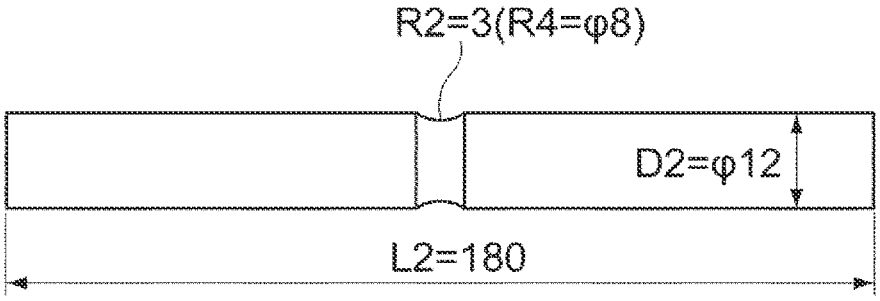
FIG. 2 is a schematic view illustrating a four-point bending test piece obtained from a round bar produced in Example.

In addition, a four-point bending test piece shown in FIG. 2 were taken from the round bars of each test number. The length L2 of the four-point bending test piece was 180 mm and the diameter D2 was φ12 mm. The radius of curvature R2 of the notch in the center of the test piece was 3 mm, and the diameter R4 of the transverse section of the test piece at the notch bottom was φ8 mm. The center of the four-point bending test piece was made to be 10 mm deep from the surface of the round bar. This means that the notch bottom of the four-point bending test piece corresponds to a depth of from 6 to 14 mm from the surface of the round bar.

The obtained Ono-type rotating bending fatigue test pieces and four-point bending test pieces were subjected to soft nitriding process at 580° C. for 2.5 h. Ammonia gas and RX gas were introduced into the furnace as a process gas with a flow rate of 1:1. After 2.5 hours, the test pieces were removed from the heat treatment furnace and quenched with an oil at 100° C.

Through the above steps, the Ono-type rotating bending fatigue test pieces and four-point bending test pieces as nitrided parts were prepared.

[Measurement of Area Fraction of Microstructures of Nitrided Layer (Surface) and Inside]

The area fraction of the microstructure near the nitrided layer (surface) of a fatigue test piece was determined using a portion of the Ono-type rotating bending fatigue test piece of each test number after nitriding. A sample for observing the microstructure was prepared to observe the transverse section of the notch bottom of the fatigue test piece. The sample was corroded with nital to reveal the microstructure and then subjected to microstructure observation. When any one point on the circular surface of the transverse section was set to 0°, the area fraction of the microstructure with the position at a depth of 0.5 mm from the surface at the center at four locations, 0°, 90°, 180°, and 270°, was measured in the same way as described above. The average of the area fraction values of the microstructures at four locations was defined as the area fraction of the microstructure of the nitrided layer.

On the other hand, the area fraction of the internal microstructure of the fatigue test piece is not affected by the nitriding process, and thus is the same as the area fraction of the internal microstructure of the round bar as the rough shaped material for nitrided parts. Because of this, the measurement is omitted.

[Measurement of Vickers Hardness of Nitrided Layer (Surface)]

The Vickers hardness of the surface of the nitrided layer was determined using the test pieces used to measure the area fraction of the microstructure of the nitrided layers. Specifically, Vickers hardness (HV) was measured according to JIS Z 2244 (2009) at any five points at a depth of about 0.05 mm from the surface. The test force was 2.9 N. The average of the five Vickers hardness values obtained was defined as the Vickers hardness of the nitrided layer (surface).

[Ono-Type Rotating Bending Fatigue Test (Fatigue Strength (MPa))]

Using the nitrided Ono-type rotating bending fatigue test pieces as described above, an Ono-type rotating bending fatigue test was performed. A rotating bending fatigue test in accordance with JIS Z2274 (1978) was performed in the atmosphere at room temperature (25° C.). The test was performed under completely reversed stress conditions at a rotational speed of 3000 rpm. In the test pieces that did not break until the completion of $1.0\times10^7$ repetitions, the highest stress was defined as the fatigue strength (MPa) of the test number. A fatigue strength of 550 MPa or more was considered as being excellent in fatigue strength.

[Four-point Bending Test (Bend Straightening Property (Straightenable Strain (με)))]

Using the nitrided four-point bending test pieces as described above, a four-point bending test was performed in the atmosphere at room temperature. The distance between the fulcrums (the distance between a fulcrum closest to the end of the test piece and a fulcrum closest to the fulcrum in the axial direction of the test piece) was 51 mm. The indentation speed was 0.5 mm/min. In order to measure the strain at the notch bottom of the test piece, a strain gauge was attached to the center of the notch bottom parallel to the axial direction of the test piece. The indentation stroke was increased at the above indentation speed. A crack was considered to have occurred in the test piece when the increment in the strain gage value for a 0.01 mm increase in the indentation stroke was 2400με or more. The amount of strain just before the crack generation was defined as the straightenable strain (με). A straightenable strain of 15,000με or more was evaluated as being excellent in bend straightening property.

[Drill Life Evaluation Test]

The quenched and tempered round bar of each test number was cut to a length of 100 mm. The cut round bars having a diameter larger than 65 mm were subjected to a surface-machining process to cut and remove one side and the opposite side by 10 mm in width (length in the radial direction of the round bar). In this way, barrel-shaped test pieces having two faces perpendicular to the bottom of the round bar and parallel to each other, with the transverse section having a height (length between the two parallel faces) of 60 mm, 80 mm, or 120 mm, were prepared (see FIGS. 3 to 6).

The cut round bars having a diameter of 55 mm or 65 mm were used to prepare test pieces with the width to be cut and removed being 5 mm and with the transverse section having a height of 45 mm or 55 mm (see FIGS. 3 to 6).

The machinability was then evaluated for the face of the test piece that had been subjected to the surface-machining process.

The drill used was a φ5 mm drill made of high-speed steel. The feed rate during machining was 0.15 mm/rev, and the rotation speed was 1,000 rpm. During machining, water-soluble emulsion was supplied at 10 L/min by external coolant supply. Under these conditions, the test piece with the transverse section having a height of 60 mm or more was drilled to form holes with a depth of 50 mm. The number of holes drilled until drilling became impossible was defined as the drilling possible number. The test piece with the transverse section having a height of 55 mm or less was drilled to form holes with a depth of 40 mm. The number of holes drilled until drilling became impossible was multiplied by 0.8 and rounded off to the nearest whole number, which was considered as the drilling possible number. The total number of holes at which drilling was finished was 216. Drilling was considered to be impossible when either breakage of the drill, abnormal sounds, or an increase in the current value (more than twice the average value for the second hole) occurred.

[Characterization of Holes (Microstructure of Drilled Through-hole)]

The determination of the microstructure through which the hole passes was performed as follows. Hereinafter, a microstructure comprising, in terms of area fraction: tempered martensite and tempered bainite in total: from 0 to less than 50%; remaining austenite: from 0 to 5%; and a balance: ferrite and perlite is described as a non-hardended steel structure. In order for 50% of the total length of the hole in the depth direction to pass through non-hardended steel structures, in the case where the total length of the hole is 40 mm, 20 mm of the hole is required to passthrough non-hardended steel structures. Non-hardended steel structures increase with distance from the center of the round bar.

Figure 3:
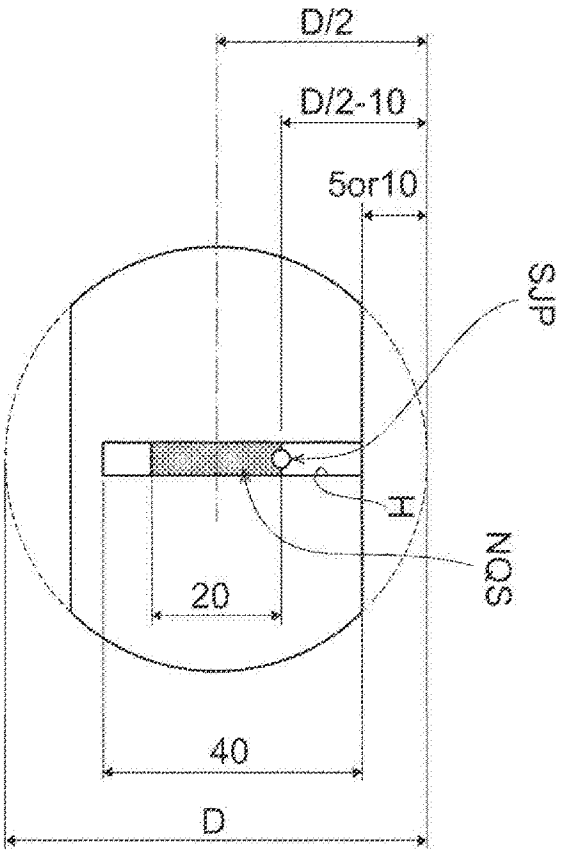
FIG. 3 is a schematic view illustrating a cross-section of a round bar with a diameter of 55 mm or 65 mm, and the positional relationship between the hole and the evaluated region in the hole characterization.

Therefore, when the position 10 mm away from the center of the round bar is a non-hardended steel structure, more than 50% of the total length of the hole is considered to pass through non-hardended steel structures. Thus, when the diameter of the round bar was 55 mm, the microstructure at 17.5 mm from the surface was evaluated, and when the diameter of the round bar was 65 mm, the microstructure at 22.5 mm from the surface was evaluated. FIG. 3 shows the cross section of the test piece and the positional relationship between the hole and the evaluated portion (i.e., the position for determining the microstructure) when the diameter of the round bar is 55 mm or 65 mm.

Figure 4:
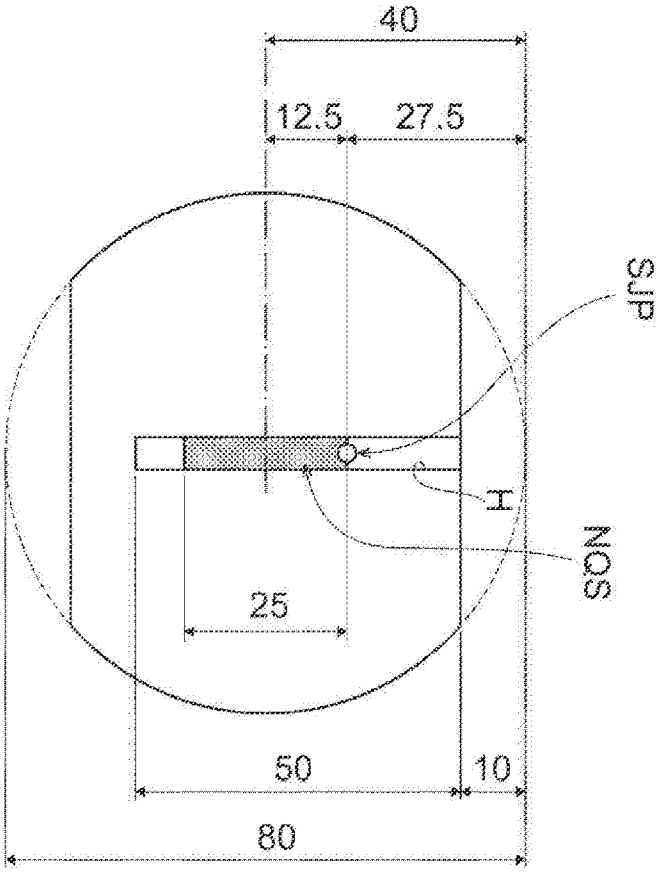
FIG. 4 is a schematic view illustrating a cross-section of a round bar with a diameter of 80 mm, and the positional relationship between the hole and the evaluated region in the hole characterization.
Figure 5:
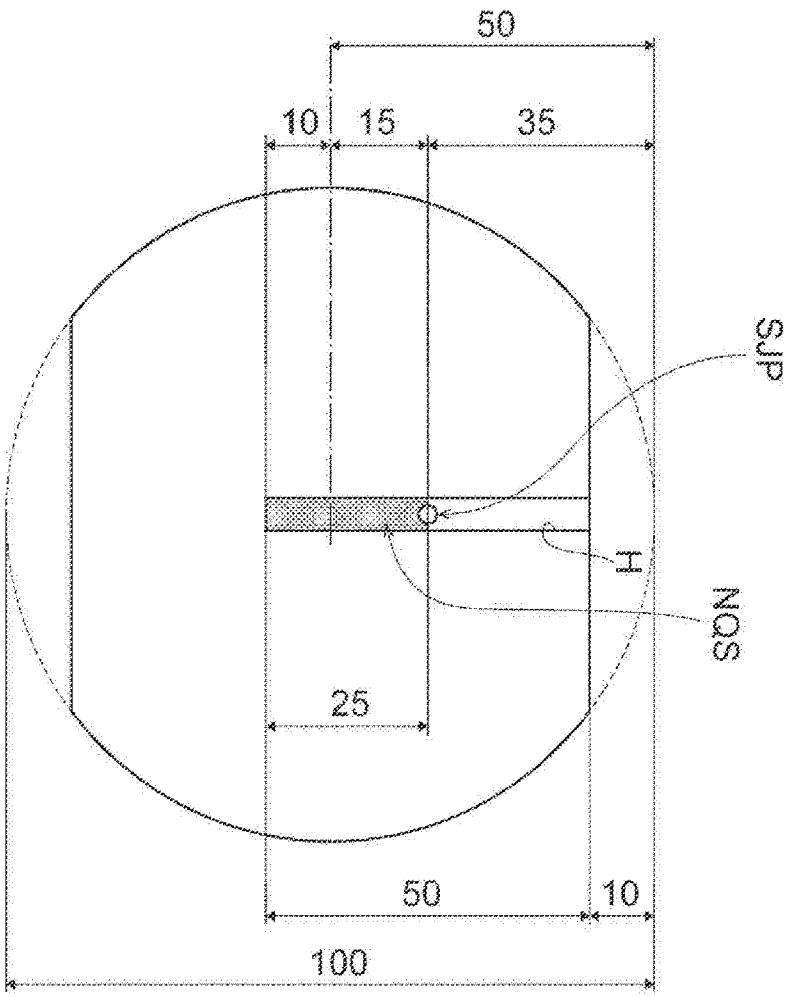
FIG. 5 is a schematic view illustrating a cross-section of a round bar with a diameter of 100 mm, and the positional relationship between the hole and the evaluated region in the hole characterization.
Figure 6:
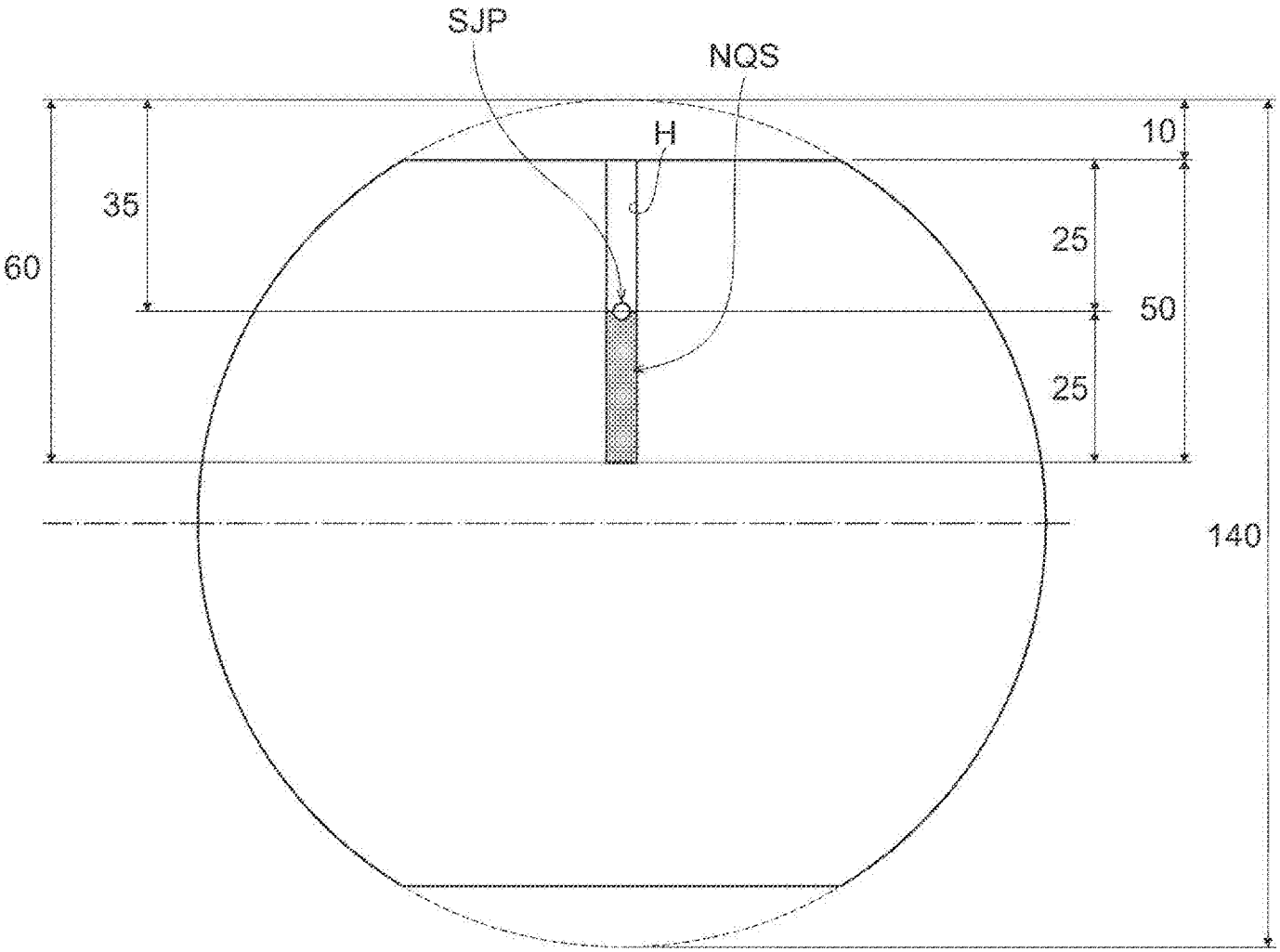
FIG. 6 is a schematic view illustrating a cross-section of a round bar with a diameter of 140 mm, and the positional relationship between the hole and the evaluated region in the hole characterization.

Similarly, in the case where the total length of the hole is 50 mm, 25 mm of the hole is required to pass through non-hardended steel structures. Therefore, the microstructure at 27.5 mm from the surface for round bar having a diameter of 80 mm, or the microstructure at 35 mm from the surface for the round bar having a diameter of 100 mm or 140 mm, was determined for whether it is a non-hardended steel structure. FIGS. 4 to 6 shows the cross section of the test piece and the positional relationship between the hole and the evaluated portion (i.e., the position for determining the microstructure) when the diameter of the round bar is 80 mm, 100 mm, or 140 mm.

For each test number, the microstructure at the above position was analyzed to determine whether 50% or more of the total length in the depth direction of the hole passed through non-hardended steel structures. The position was evaluated as Y when 50% or more passed through non-hardended steel structures, while evaluated as N when did not pass through non-hardended steel structures.

In FIG. 3, D indicates the diameter of the round bar (55 mm or 65 mm). In FIGS. 3 to 6, H indicates a hole, SJP indicates a position for evaluating the microstructure, and NQS indicates a region that can be considered as non-hardended steel structure when the position for evaluating the microstructure is a non-hardended steel structure The test results are shown in Tables 2 and 3 below. The "microstructure fraction" in Table 3 means the fraction of each microstructure constituting the steel. "Fatigue strength" means the fatigue strength (MPa) obtained in the Ono-type rotary bending test, "strain" means the straightenable strain (με), and "number of drilled holes" means the number of drilled holes obtained in the drill life evaluation test.

The abbreviations in Tables 2 and 3 are as follows:

φ: Diameter (mm) of the round bar;

TMA+TBA+residual γ: the total area fraction (%) of tempered martensite, tempered bainite, and remaining austenite;

α+PA: the total area fraction (%) of ferrite and perlite;

Remaining γ: the area fraction (%) of remaining austenite;

Hardness: Vickers hardness (Hv);

Hardness of nitrided layer: the Vickers hardness (Hv) of the nitrided layer (surface) of the nitrided part.

TABLE 2

Fatigue strength and straightenable strain of Examples

| | | | Heating Condition | |
|---|---|---|---|---|
| Test No. | Steel | φ | First Sep | Second Step |
| 1 | A | 80 | 860° C. × 1 h => water cooling | 640° C. × 1 h => standing to cool |
| 2 | B | 80 | 830° C. × 1 h => oil cooling | 620° C. × 1 h => standing to cool |
| 3 | C | 80 | 860° C. × 1 h => water cooling | 640° C. × 1 h => standing to cool |
| 4 | C | 65 | 860° C. × 1 h => water cooling | 620° C. × 1 h => standing to cool |
| 5 | C | 100 | 860° C. × 1 h => water cooling | 620° C. × 1 h => standing to cool |
| 6 | D | 80 | 860° C. × 1 h => water cooling | 640° C. × 1 h => standing to cool |
| 7 | E | 80 | 830° C. × 1 h => oil cooling | 620° C. × 1 h => standing to cool |
| 8 | F | 80 | 860° C. × 1 h => water cooling | 640° C. × 1 h => standing to cool |
| 9 | G | 80 | 810° C. × 1 h => water cooling | 640° C. × 1 h => standing to cool |
| 10 | H | 80 | 810° C. × 1 h => water cooling | 640° C. × 1 h => standing to cool |
| 11 | H | 100 | 810° C. × 1 h => water cooling | 620° C. × 1 h => standing to cool |
| 12 | I | 80 | 810° C. × 1 h => water cooling | 640° C. × 1 h => standing to cool |
| 13 | J | 80 | 810° C. × 1 h => water cooling | 640° C. × 1 h => standing to cool |
| 14 | K | 80 | 810° C. × 1 h => water cooling | 640° C. × 1 h => standing to cool |
| 15 | L | 80 | 810° C. × 1 h => water cooling | 640° C. × 1 h => standing to cool |
| 16 | M | 80 | 810° C. × 1 h => water cooling | 640° C. × 1 h => standing to cool |
| 17 | N | 80 | 810° C. × 1 h => water cooling | 640° C. × 1 h => standing to cool |
| 18 | O | 80 | 810° C. × 1 h => water cooling | 640° C. × 1 h => standing to cool |
| 19 | P | 80 | 810° C. × 2 h => water cooling | 620° C. × 2 h => standing to cool |

TABLE 2-continued

Fatigue strength and straightenable strain of Examples

| Test No. | Steel | φ | Heating Condition: First Sep | Heating Condition: Second Step |
|---|---|---|---|---|
| 20 | Q | 80 | 810° C. × 1 h => water cooling | 640° C. × 1 h => standing to cool |
| 21 | R | 80 | 810° C. × 1 h => water cooling | 640° C. × 1 h => standing to cool |
| 22 | S | 80 | 810° C. × 1 h => water cooling | 640° C. × 1 h => standing to cool |
| 23 | T | 80 | 810° C. × 1 h => water cooling | 640° C. × 1 h => standing to cool |
| 24 | U | 80 | 860° C. × 1 h => water cooling | 610° C. × 1 h => standing to cool |
| 25 | C | 55 | 860° C. × 1 h => water cooling | 640° C. × 1 h => standing to cool |
| 26 | C | 140 | 860° C. × 1 h => water cooling | 640° C. × 1 h => standing to cool |
| 27 | H | 55 | 810° C. × 1 h => water cooling | 640° C. × 1 h => standing to cool |
| 28 | H | 140 | 810° C. × 1 h => water cooling | 640° C. × 1 h => standing to cool |
| 29 | E | 55 | 830° C. × 1 h => oil cooling | 640° C. × 1 h => standing to cool |
| 30 | E | 140 | 830° C. ° C. × 1 h => oil cooling | 640° C. × 1 h => standing to cool |

The underlined steels have components deviating from the specified range of the present disclosure.
The underlined properties deviate from the specified range of the present disclosure.

TABLE 3-1

Fatigue strength and straightenable strain of Examples

| Test No. | Steel | Microstructure of surface of roughly-shaped steel material: TMA + TBA + remaining γ | α + PA | Remaining γ | Hardness (HV) | Microstructure of inside of roughly-shaped steel material: TMA + TBA + remaining γ | α + PA | Remaining γ | Hardness (HV) |
|---|---|---|---|---|---|---|---|---|---|
| 1 | A | 100 | 0 | 1 | 255 | 16 | 84 | 1 | 241 |
| 2 | B | 100 | 0 | 1 | 256 | 0 | 100 | 0 | 241 |
| 3 | C | 100 | 0 | 0 | 246 | 22 | 78 | 1 | 236 |
| 4 | C | 100 | 0 | 1 | 250 | 34 | 66 | 1 | 240 |
| 5 | C | 86 | 14 | 0 | 244 | 10 | 90 | 1 | 234 |
| 6 | D | 100 | 0 | 0 | 249 | 13 | 87 | 1 | 235 |
| 7 | E | 100 | 0 | 1 | 252 | 0 | 100 | 2 | 240 |
| 8 | F | 100 | 0 | 0 | 249 | 12 | 88 | 1 | 238 |
| 9 | G | 100 | 0 | 1 | 255 | 11 | 89 | 2 | 243 |
| 10 | H | 100 | 0 | 3 | 259 | 15 | 85 | 1 | 249 |
| 11 | H | 80 | 20 | 3 | 250 | 18 | 82 | 1 | 240 |
| 12 | I | 100 | 0 | 3 | 262 | 29 | 71 | 2 | 252 |
| 13 | J | 100 | 0 | 2 | 249 | 15 | 85 | 1 | 241 |
| 14 | K | 100 | 0 | 2 | 244 | 12 | 88 | 0 | 232 |
| 15 | L | 100 | 0 | 1 | 244 | 12 | 88 | 0 | 237 |
| 16 | M | 100 | 0 | 1 | 249 | 13 | 87 | 1 | 237 |
| 17 | N | 100 | 0 | 2 | 240 | 9 | 91 | 0 | 230 |
| 18 | O | 100 | 0 | 3 | 270 | 33 | 67 | 2 | 260 |
| 19 | P | 100 | 0 | 1 | 270 | 13 | 87 | 0 | 269 |
| 20 | Q | 94 | 6 | 1 | 199 | 11 | 89 | 1 | 195 |
| 21 | R | 11 | 89 | 0 | 189 | 0 | 100 | 1 | 184 |
| 22 | S | 100 | 0 | 1 | 296 | 89 | 11 | 0 | 291 |
| 23 | T | 100 | 0 | 1 | 279 | 75 | 25 | 1 | 272 |
| 24 | U | 5 | 95 | 0 | 201 | 0 | 100 | 1 | 196 |
| 25 | C | 100 | 0 | 0 | 252 | 100 | 0 | 1 | 242 |
| 26 | C | 26 | 74 | 0 | 231 | 0 | 100 | 1 | 218 |
| 27 | H | 100 | 0 | 1 | 260 | 100 | 0 | 1 | 252 |
| 28 | H | 31 | 69 | 0 | 234 | 0 | 100 | 0 | 215 |
| 29 | E | 100 | 0 | 1 | 253 | 100 | 0 | 1 | 246 |
| 30 | E | 16 | 84 | 0 | 228 | 0 | 100 | 1 | 210 |

The underlined steels have deviating from the specified range of the present disclosure.
The underlined properties deviate from the specified range of the present disclosure.

TABLE 3-2

Fatigue strength and straightenable strain of Examples

| Test No. | Steel | Microstructure of surface of nitrided part: TMA + TBA + remaining γ | α + PA | Remaining γ | Nitriding properties: Hardness of nitrided layer (HV) | Fatigue Strength | Straightening property | Number of drilled holes | Microstructure of Drilled Through-hole |
|---|---|---|---|---|---|---|---|---|---|
| 1 | A | 100 | 0 | 1 | 450 | 610 | 17216 | 216 | Y |
| 2 | B | 100 | 0 | 2 | 444 | 610 | 18951 | 216 | Y |

TABLE 3-2-continued

| Fatigue strength and straightenable strain of Examples | | | | | | | | | |
|---|---|---|---|---|---|---|---|---|---|
| | | | | | Nitriding properties | | | | |
| | | Microstructure of surface of nitrided part | | | Hardness of | | | | |
| Test No. | Steel | TMA + TBA + remaining γ | α + PA | Remaining γ | nitrided layer (HV) | Fatigue Strength | Straightening property | Number of drilled holes | Microstructure of Drilled Through-hole |
| 3 | C | 100 | 0 | 1 | 398 | 550 | 66482 | 216 | Y |
| 4 | C | 100 | 0 | 2 | 449 | 560 | 61110 | 186 | Y |
| 5 | C | 92 | 8 | 1 | 415 | 550 | 51081 | 216 | Y |
| 6 | D | 100 | 0 | 1 | 415 | 590 | 35810 | 216 | Y |
| 7 | E | 100 | 0 | 3 | 412 | 620 | 37115 | 216 | Y |
| 8 | F | 100 | 0 | 3 | 420 | 580 | 18462 | 216 | Y |
| 9 | G | 100 | 0 | 2 | 430 | 630 | 16558 | 216 | Y |
| 10 | H | 100 | 0 | 1 | 405 | 600 | 18225 | 190 | Y |
| 11 | H | 88 | 12 | 2 | 426 | 600 | 24165 | 192 | Y |
| 12 | I | 100 | 0 | 2 | 385 | 550 | 17056 | 160 | Y |
| 13 | J | 100 | 0 | 1 | 390 | 580 | 20012 | 216 | Y |
| 14 | K | 100 | 0 | 1 | 390 | 550 | 18640 | 216 | Y |
| 15 | L | 100 | 0 | 2 | 387 | 550 | 20081 | 216 | Y |
| 16 | M | 100 | 0 | 1 | 399 | 580 | 28950 | 216 | Y |
| 17 | N | 100 | 0 | 1 | 386 | 550 | 65515 | 216 | Y |
| 18 | O | 100 | 0 | 4 | 362 | 530 | 23891 | 88 | Y |
| 19 | P | 100 | 0 | 0 | 429 | 600 | 9678 | 84 | Y |
| 20 | Q | 100 | 0 | 0 | 358 | 420 | 59815 | 216 | Y |
| 21 | R | 20 | 80 | 1 | 320 | 410 | 62700 | 216 | Y |
| 22 | S | 100 | 0 | 2 | 465 | 660 | 12240 | 36 | N |
| 23 | T | 100 | 0 | 2 | 455 | 670 | 8864 | 59 | N |
| 24 | U | 12 | 88 | 1 | 302 | 380 | 64188 | 216 | Y |
| 25 | C | 100 | 0 | 2 | 404 | 550 | 66482 | 94 | Y |
| 26 | C | 35 | 65 | 1 | 349 | 490 | 66482 | 216 | Y |
| 27 | H | 100 | 0 | 3 | 428 | 600 | 18155 | 74 | Y |
| 28 | H | 44 | 56 | 0 | 399 | 510 | 18961 | 216 | Y |
| 29 | E | 100 | 0 | 2 | 429 | 610 | 39815 | 94 | Y |
| 30 | E | 22 | 78 | 1 | 400 | 450 | 41578 | 216 | Y |

The underlined steels have deviating from the specified range of the present disclosure.
The underlined properties deviate from the specified range of the present disclosure.

[Test Result]

Referring to Table 3, the Test Nos. 1 to 17 show chemical compositions and steel microstructures that are within the range of the present disclosure. The steels of the test numbers show 550 MPa or more of fatigue strength, 16558με or more of straightenable strain, 160 holes or more of number of drilled holes, indicating that they have all fatigue strength, straightening property, and machinability.

In contrast, in the case of the "Comparative Examples" for Test Nos. 18 to 30, which deviate from the specification of the present disclosure, the chemical composition and the steel microstructure are outside the range of this disclosure, and the target performance is not obtained. Specifically, the results are as follows.

Test No. 18 illustrates the case of an excessive amount of C, which resulted in a small number of drilled holes and deteriorated machinability.

Test No. 19 illustrates the case of an excessive amount of V, which resulted in deteriorated bend straightening property.

Test No. 20 illustrates the case of a low amount of C, which resulted in deteriorated fatigue strength.

Test No. 21 illustrates the case of a low amount of Mn, in which both of the microstructures of the surface and the inside of the roughly-shaped steel material and nitrided part were a non-hardended steel structure (microstructure mainly comprising ferrite and perlite), which resulted in deteriorated hardness and fatigue strength of the nitrided layer.

Test No. 22 illustrates the case of an excessive amount of Mn, which resulted in deteriorated straightening property, as well as in a small number of drilled holes and deteriorated machinability.

Test No. 23 illustrates the case of an excessive amount of Cr, which resulted in deteriorated straightening property, as well as in a small number of drilled holes and deteriorated machinability.

Test No. 24 illustrates the case of a low amount of Mn, in which both of the microstructures of the surface and the inside of the roughly-shaped steel material and nitrided part were a non-hardended steel structure (microstructure mainly comprising ferrite and perlite), which resulted in deteriorated hardness and fatigue strength of the nitrided layer.

Test Nos. 25, 27, and 29 used a test piece (round bar) having a small diameter, in which both of the microstructures of the surface and the inside of the roughly-shaped steel material and nitrided part were a hardended steel structure (microstructure mainly comprising tempered martensite and tempered bainite), which resulted in small number of drilled holes and deteriorated machinability.

Test Nos. 26, 28, and 30 used a test piece (round bar) having a large diameter, in which both of the microstructures of the surface and the inside of the roughly-shaped steel material and nitrided part were a non-hardended steel structure (microstructure mainly comprising ferrite and perlite), which resulted in deteriorated fatigue strength.

The embodiments of the present disclosure have been described above. However, the embodiments described above are only for illustrating the present disclosure. Thus, the present disclosure is not limited to the embodiments described above, and any modifications can be made to the embodiments, as appropriate, without departing from the scope and spirit of the disclosure.

The disclosure of JP-A No. 2018-202914 is incorporated herein by reference in its entirety.

All documents, patent applications, and technical standards described herein are incorporated herein by reference to the same extent as if the individual documents, patent applications, and technical standards were specifically and individually incorporated by reference.

The invention claimed is:

1. A nitrided part comprising a roughly-shaped material having a chemical composition comprising, by % by mass:
C: from 0.35 to 0.45%;
Si: from 0.10 to 0.50%;
Mn: from 1.5 to 2.5%;
P: 0.05% or less;
S: from 0.005 to 0.100%;
Cr: from 0.15 to 0.60%;
Al: from 0.001 to 0.080%;
N: from 0.003 to 0.025%;
Mo: from 0 to 0.50%;
Cu: from 0 to 0.50%;
Ni: from 0 to 0.50%;
Ti: from 0 to 0.050%;
Nb: from 0 to 0.050%;
Ca: from 0 to 0.005%;
Bi: from 0 to 0.30%;
V: from 0 to 0.05%; and
a balance comprising Fe and impurities;
wherein the portion with a diameter or width ranging from 60 to 130 mm of the nitrided part has a microstructure at a depth of 0.5 mm from the surface comprising, in terms of area fraction:
tempered martensite and tempered bainite in total: from 70 to 100%;
remaining austenite: from 0 to 5%; and
a balance: ferrite and perlite;
wherein the portion with a diameter or width ranging from 60 to 130 mm of the nitrided part has a microstructure at a depth of 15 mm or more from the surface comprising, in terms of area fraction:
tempered martensite and tempered bainite in total: from 0 to less than 50%;
remaining austenite: from 0 to 5%; and
a balance: ferrite and perlite; and
wherein the portion with a diameter or width ranging from 60-130 mm of the nitrided part has a Vickers hardness at a depth of 0.05 mm from the surface of from 350-550 HV.

2. The nitrided part according to claim 1,
comprising, in the portion with a diameter or width ranging from 60 to 130 mm of the nitrided part, a single hole or a plurality of holes having L/D, which is a ratio of a depth L to a diameter D, of 8 or more, with the depth L being 60 mm or more;
wherein 50% or more of a total length of each hole in a depth direction passes through a portion having a microstructure comprising, in terms of area fraction:
tempered martensite and tempered bainite in total: from 0 to less than 50%;
remaining austenite: from 0 to 5%; and
a balance: ferrite and perlite.

3. The nitrided part according to claim 2,
wherein the roughly-shaped material comprises, by % by mass, one or more of:
Mo: from more than 0 to 0.50%;
Cu: from more than 0 to 0.50%; or
Ni: from more than 0 to 0.50%.

4. The nitrided part according to claim 3,
wherein the roughly-shaped material comprises, by % by mass, one or two of:
Ti: from more than 0 to 0.050%; or
Nb: from more than 0 to 0.050%.

5. The nitrided part according to claim 3,
wherein the roughly-shaped material comprises, by % by mass, one or more of:
Ca: from more than 0 to 0.005%;
Bi: from more than 0 to 0.30%, or
V: from 0 to 0.05%.

6. The nitrided part according to claim 2,
wherein the roughly-shaped material comprises, by % by mass, one or two of:
Ti: from more than 0 to 0.050%; or
Nb: from more than 0 to 0.050%.

7. The nitrided part according to claim 2,
wherein the roughly-shaped material comprises, by % by mass, one or more of:
Ca: from more than 0 to 0.005%;
Bi: from more than 0 to 0.30%, or
V: from 0 to 0.05%.

8. The nitrided part according to claim 1,
wherein the roughly-shaped material comprises, by % by mass, one or more of:
Mo: from more than 0 to 0.50%;
Cu: from more than 0 to 0.50%; or
Ni: from more than 0 to 0.50%.

9. The nitrided part according to claim 8,
wherein the roughly-shaped material comprises, by % by mass, one or two of:
Ti: from more than 0 to 0.050%; or
Nb: from more than 0 to 0.050%.

10. The nitrided part according to claim 8,
wherein the roughly-shaped material comprises, by % by mass, one or more of:
Ca: from more than 0 to 0.005%;
Bi: from more than 0 to 0.30%, or
V: from 0 to 0.05%.

11. The nitrided part according to claim 1,
wherein the roughly-shaped material comprises, by % by mass, one or two of:
Ti: from more than 0 to 0.050%; or
Nb: from more than 0 to 0.050%.

12. The nitrided part according to claim 11,
wherein the roughly-shaped material comprises, by % by mass, one or more of:
Ca: from more than 0 to 0.005%;
Bi: from more than 0 to 0.30%, or
V: from 0 to 0.05%.

13. The nitrided part according to claim 1,
wherein the roughly-shaped material comprises, by % by mass, one or more of:
Ca: from more than 0 to 0.005%;
Bi: from more than 0 to 0.30%, or
V: from 0 to 0.05%.

* * * * *